United States Patent [19]

Baker et al.

[11] Patent Number: 4,530,347

[45] Date of Patent: Jul. 23, 1985

[54] GAS-FIRED WATER HEATERS

[75] Inventors: Michael J. Baker, Birmingham; Geoffrey J. Hardwick, London, both of England

[73] Assignee: British Gas Corporation, London, England

[21] Appl. No.: 641,585

[22] Filed: Aug. 17, 1984

[30] Foreign Application Priority Data

Oct. 14, 1983 [GB] United Kingdom ..... 8327627

[51] Int. Cl.[3] ..... F24H 1/20

[52] U.S. Cl. ..... 126/360 R; 126/360 A; 122/31 R; 110/215

[58] Field of Search ..... 122/31 R, 31 A; 110/215; 126/367, 368, 360 R, 360 A

[56] References Cited

U.S. PATENT DOCUMENTS

| | | | |
|---|---|---|---|
| 499,403 | 6/1893 | Sugg | 126/360 R |
| 629,520 | 7/1899 | Mond | 122/31 R |
| 1,322,024 | 11/1919 | Kaiser | 126/360 R |
| 4,069,807 | 1/1978 | Hantig | 126/360 R |
| 4,326,581 | 4/1982 | Rapier | 122/31 R |

FOREIGN PATENT DOCUMENTS

| | | | |
|---|---|---|---|
| 249728 | 10/1911 | Fed. Rep. of Germany | 126/360 R |
| 57-14145 | 1/1982 | Japan | 126/360 A |
| 57-52740 | 3/1982 | Japan | 126/360 A |
| 178312 | 4/1922 | United Kingdom | 126/360 R |
| 304959 | 7/1971 | U.S.S.R. | 126/360 R |
| 510627 | 6/1976 | U.S.S.R. . | |

*Primary Examiner*—Henry C. Yuen

*Attorney, Agent, or Firm*—Watson, Cole, Grindle & Watson

[57] ABSTRACT

A compact gas-fired water heater in which a reservoir of bulk water is bath heated, indirectly by a gas burner-fired immersion tube and directly heated by mutual contact between the hot flue gases from the immersion tube outlet and feed water droplets as they pass each other in a contra-flow through apertures in a plurality of plates.

11 Claims, 3 Drawing Figures

100
75
50
25
WATER HEATING EFFICIENCY (%)
B
A
50
75
100
WATER TEMPERATURE (°C)

GAS-FIRED WATER HEATERS

BACKGROUND OF THE INVENTION

1. Field of the Invention

This invention relates to gas-fired water heaters, and more particularly to such water heaters of the kind in which heat exchange takes place by direct contact of the combustion product gases from a gas burner with the feed water.

2. The Prior Art

One known heater of this kind uses a low intensity ring-type gas burner, the combustion products of which flow up and down through annuli in the heater and come into direct contact with high pressure jets of feed water. The disadvantages with this type of heater is that it is both bulky and costly in that it uses a large low-intensity burner system, large and complicated heat transfer members, and a complicated high pressure sprayed water pumping system whose range of water flow rates is small.

Another known heater of this kind uses a burner which fires horizontally into an open-bottomed combustion canopy located in the path of downwardly flowing feed water droplets, the combustion product gases emerging from the bottom of the combustion canopy and flowing upwardly in direct contact with the water droplets. This kind of water heater relies upon a large upper surface area for the combustion canopy to provide an acceptable heat exchanger, the sides of the canopy being poor in this respect. Also, since the upper surface of the combustion canopy is cooled only by water droplets, the high surface temperature gives rise to the production of steam which necessitates the provision of a large upper heat exchanger to recondense the steam. Furthermore, such a heater cannot be fired without any flow of water droplets otherwise overheating will occur.

Known direct contact water heaters are also disadvantageous in that as the bulk water outlet temperature rises an increasing proportion of the available source heat input is used wastefully to evaporate the bulk water to such an extent that at approximately 89° C. water temperature, all of the available heat is used in evaporating the bulk water. Thus, the water heating efficiency gradually drops off until at this point it becomes zero. This is shown clearly by the curve "A" on the graph of FIG. 3 of the accompanying drawings.

It will be appreciated that in view of the current emphasis being placed on the conservation of energy, there is an urgent need in the field of water heating appliances for a product that improves efficiency.

SUMMARY OF THE INVENTION

An object of the present invention is to provide an improved compact gas-fired water heater designed to overcome the aforesaid disadvantages with known heaters.

According to the present invention, there is provided a compact gas-fired water heater comprising, a casing defining a reservoir for collecting water supplied as streams by a water distribution means, a heat exchanger located within the reservoir to receive hot product gases of combustion for heat exchange with the water in the reservoir, outlet means from the heat exchanger for discharging the gases towards the water distribution means, heat transfer means located between the reservoir and the water distribution means for providing heat transfer between the gas and the water issuing from the water distribution means and an exhaust gas outlet located above the water distribution means.

Embodiments of the invention will now be described by way of example with reference to the accompanying drawings.

DETAILED DESCRIPTION OF THE PREFERRED EMBODIMENTS

Figure 1:
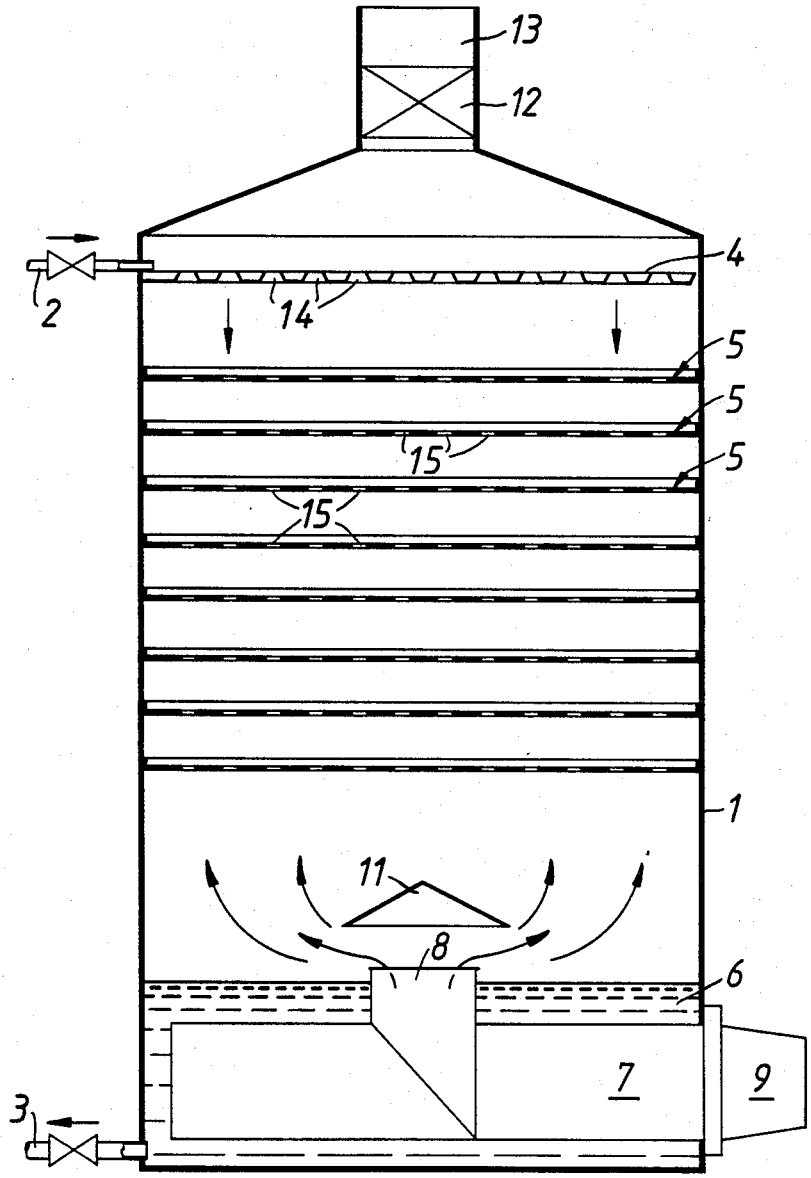
FIG. 1 is a diagrammatic sectional view of a water heater in accordance with the invention.

Referring to FIG. 1 of the drawings, the water heater comprises an outer casing 1 having a feed water inlet 2 and a hot water outlet 3, the interior of the casing defining an upper section in which is mounted a water distribution plate 4 just below the inlet 2, a middle direct heat transfer section in which is mounted, one above another, a plurality of spaced apart perforated plates 5, and a lower indirect heat exchange section which provides a hot water reservoir 6 and in which is located an immersion tube heat exchanger 7 in the form of a combustion chamber having an outlet 8 for the passage of hot product gases of combustion from a high intensity packaged gas burner 9 mounted on the outside of the casing and arranged to fire into the immersion tube 7. A canopy deflector 11 is fitted over the immersion tube outlet 8, and a demister pad 12 is provided in an exhaust produce gas outlet 13 at the top of the heater so as to remove any entrained water particles.

The water distribution plate 4 is in the form of a shallow metal tray having numerous substantially equispaced apertures 14, each of which is formed with an upstanding rim. In this way, feed water from the inlet 2 will collect in the troughs around the rimmed apertures 14 and eventually spill over the rims in weir-like manner through the apertures to produce an evenly distributed shower or stream of water droplets into the middle section over the whole area thereof.

The perforate plates 5 may be simple flat metal plates formed with numerous substantially equispaced holes 15 through which the feed water from the distribution plate passes.

Alternatively, these apertured plates 5 may be constructed in a manner similar to that just described for the distribution plate 4.

The numbers and size of the apertures in the plates 4 and 5 will depend on a number of design factors involving heater capacity, water flow rate, burner flow rate, required efficiency, etc., but will be such that the total area of the combined areas of the apertures in each plate is between 10% and 50% of the total area of the plate and preferably about 30% thereof.

In operation of the water heater, the high intensity packaged gas burner 9 fires hot combustion product gases into the immersion tube heat exchanger 7 which is designed indirectly to exchange a substantial part of the available heat from the burner's hot combustion product gases to the surrounding water reservoir 6. The gases will leave the tube 7 through the outlet 8 at a relative low temperature of between 400°-800° C. The canopy 11 shields the outlet from falling water and may assist in the upward distribution of product gases. These hot gases then travel upwardly impinging upon, and passing through the apertures in, the perforate plates 5 and distribution plate 4 so as to be in direct heat exchange contact with the shower or streams of water droplets flowing in a counter flow direction. By the time the product gases reach the top of the upper section of the heater, most of the available heat has been removed and the product gases leave the flue outlet 8 at a few degrees centigrade above the feed water inlet temperature. Make-up or recirculated water is introduced through the inlet 2 to the top of the heater and passes through the apertures 14 in the distribution plate 4. It then passes down through the holes 15 in the perforated plates 5 of the middle direct contact section and then to the lower section where the temperature is boosted by the immersion tube 7 before it is drawn off on demand through the outlet 3.

The water heater shown in FIG. 1 and described above is suitable for industrial and commercial purposes, e.g., providing hot water for cleaning and washing purposes. For instance, in the industrial sector it can be used to provide hot water for cleaning steel plates and the like after or during manufacture, and in the textile industry for general washing and cleaning. In the commercial sector, it can be used in laundries and swimming pools to provide the necessary heated water.

Figure 2:
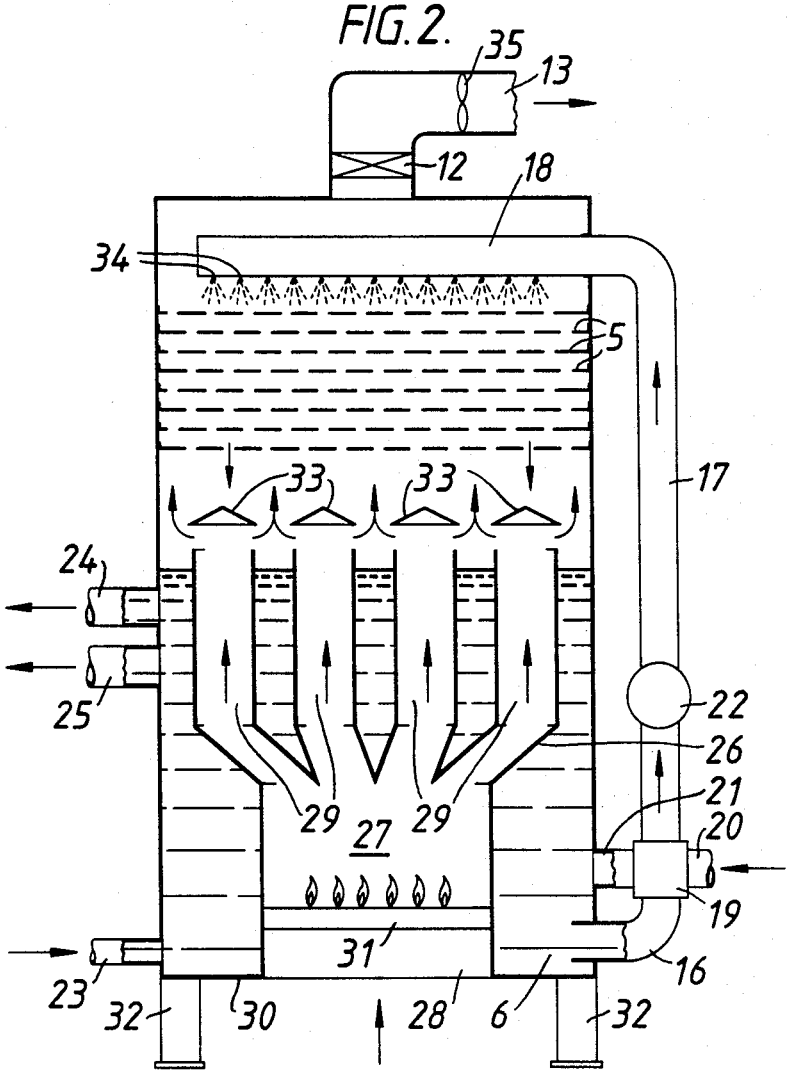
FIG. 2 is a diagrammatic sectional view of another embodiment of a water heater in accordance with the invention.

Referring to FIG. 2 where identical parts bear the same reference numerals as in FIG. 1, the water heater shown is designed for domestic heating to provide hot water for domestic purposes e.g., washing and for space heating.

The heater comprises a lower feed water pipe 16 and an upper feed water pipe 17, the lower pipe 16 serving as an outlet for colder reservoir water and the upper pipe 17 serving as a feed water inlet to the water distribution means 18. The lower pipe 16 terminates in a mixing valve 19 within which the colder reservoir water can mix with return water from the space heating system, the return water being conveyed by the return water pipe 20 which also terminates in the valve 19. Leading from the valve 19 is a reservoir return pipe 21 and the upper feed water pipe 17. The valve 19 is set either to discharge the water into the upper pipe 17 for further heating if required or into the pipe 21 for return to the reservoir 6, the valve 19 being controlled by appropriate thermostatic controls (not shown) responsive to room and hot water temperatures. A pump 22 serves to pump water from the valve 19 to the water distribution means 18.

Cold mains water to replenish the reservoir 6 is supplied by a mains water supply pipe 23 located near the base of the reservoir.

Hot water for domestic purposes is drawn off by the pipe 24 located near the top of the reservoir 6.

Hot flow water for space heating is drawn off by the pipe 25 located below the pipe 24 near the top of the reservoir 6.

The heat exchanger 26 comprises a hollow housing 27 having an open lower end 28 and several (four shown) fire tubes 29 extending upwardly from the top of the housing 27. The reservoir 6 is formed between the heat exchanger 26 and the casing 1 and to this end, the lower end 28 of the housing 27 is sealingly secured to the base 30 of the casing 1, the base 30 thus forming the base of the reservoir 6.

A gas burner 31 is located within and extends horizontally across the housing 27 which forms a combustion chamber for the hot product gases leaving the burner 31.

Air for combustion is drawn in through the lower end of the housing 27, the casing 1 being supported off the ground by four legs 32 (only two shown) to permit the entry of air into the housing 27.

Each of the fire tubes 29 terminates, in use, above the normal upper level of the water in the reservoir 6. The upper water level is set by means of a level limit switch (not shown) situated beneath the mouths of the tubes 29. The switch controls a valve which itself controls the supply of mains water to the reservoir 6, the mains water being supplied to the reservoir 6 to replenish it when water has been drawn off for domestic use.

Each fire tube 29 is provided with a canopy deflector 33 to deflect water discharging from the plates 5.

The water distribution mean 18 comprises a tube extending across the casing and provided with lowermost apertures 34 through which water discharges as streams to the plates 5.

The exhaust gas outlet 13 is provided with a fan 35 to assist in the withdrawal of spent gas from the heater.

Figure 3:
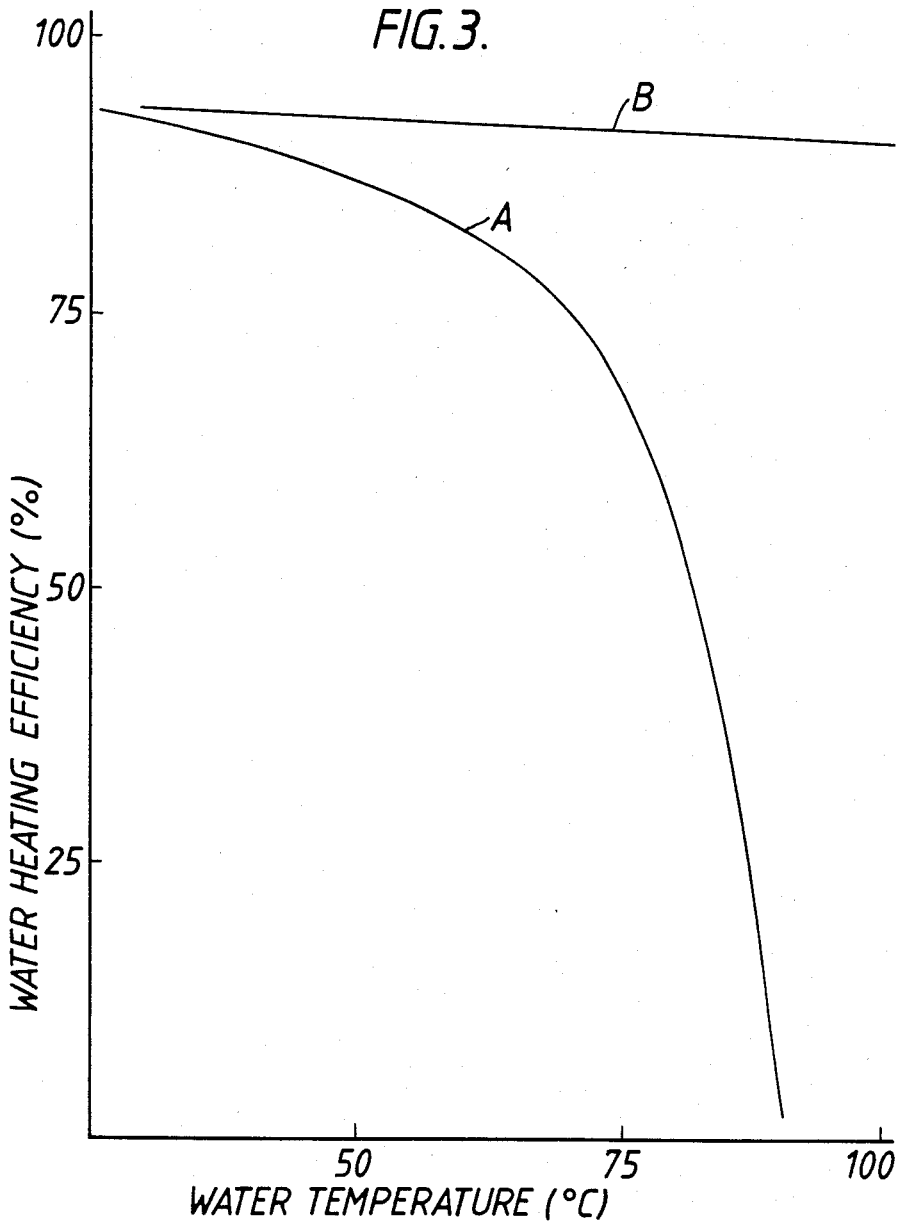
FIG. 3 is graph showing water heating efficiency against water temperature for "A" a typical known direct contact water heater, and "B" a water heater in accordance with an embodiment of the invention.

Referring to FIG. 3 in a test of a typical gas-fired water heater in accordance with that shown in FIG. 1 of the invention, the performance data was as follows:

| | |
|---|---|
| Gas flow rate | 10.8 $m^3$/hr. |
| Water flow rate | 20.2 liters/min. |
| Water inlet temperature | 13.0° C. |
| Water outlet temperature | 87.5° C. |
| Flue exhaust gas temperature | 30.0° C. |

This corresponds to an overall heater efficiency in excess of 90% based on the gross calorific value of the fuel gas and water temperature change and is represented by the substantially flat horizontal curve "B" in the graph of FIG. 3, which also demonstrates that, contrary to the efficiency performance of known direct contact water heaters (e.g. as represented by curve "A" on the graph), the overall efficiency of a heater in accordance with the invention is only marginally reduced as the water outlet temperature is raised.

A water heater in accordance with the invention overcomes the aforementioned disadvantages by using a compact type heat exchanger in the lower part of the heater. This allows the greater proportion of the heat to be released to the water and therefore reduces the required size of the middle direct contact section considerably. This system is unique and is not employed by any other known heater.

Its particular advantages are:

(i) The heater can attain higher water temperature than can be achieved with direct contact alone, without any loss in efficiency. The energy efficiency at high temperatures is made possible by the incorporation of an indirect immersion heater following the direct water/gas contact arrangement.

(ii) High heat transfer rates which leads to lower tube exit temperatures thus resulting in a smaller direct contact section, and therefore a more compact heater.

(iii) No large quantities of steam are formed as the water is heated gradually as it passes through the heater, rather than being evaporated and recondensed.

(iv) A wider range of water flow rates and temperatures are obtainable. This is because the reservoir water residence time can easily be altered by varying the water flow rate. In other known devices the residence time is fixed by a specific spray and/or gravity water feed rate.

(v) The choice of firing the immersion heater, with or without the middle direct contact section operating, without a great loss in efficiency. This feature will allow the heater to be installed in a wider variety of applicationus where make-up water is not always required continuously.

(vi) There is no need for a pressurized or complicated water spray system.

We claim:

1. A compact, gas-fired water heater which comprises a casing that has an upper portion and a lower portion, said lower portion providing a reservoir for containing water; a water distribution means positioned within said casing at a location above said reservoir, said water distribution means being capable of discharging streams of water towards said reservoir; a feed water inlet means extending into said casing for supplying feed water to said water distribution means; a heat exchanger positioned within the reservoir of said casing, said heat exchanger being capable of receiving heat combustion gases and transferring the heat therein to water in the reservoir of said casing; a first gas outlet means connected to the heat exchanger for discharging the combustion gases therein upwardly towards said water distribution means; heat transfer means positioned within said casing between said reservoir and said water distribution means for enabling heat transfer between the combustion gases emitted by said first gas outlet means and the water streams falling from said water distribution means, said heat transfer means comprising a plurality of plates that are horizontally positioned one above another, each of said plates having a predetermined number and size of apertures; and a second gas outlet means connected to the upper portion of said casing.

2. A water heater as claimed in claim 1, wherein said plates have an identical total area, and wherein the apertures in each plate constitute between 10 and 50% of the total area thereof.

3. A water heater as claimed in claim 1 or claim 2, wherein each aperture is formed with an upstanding rim.

4. A water heater as claimed in claim 1, wherein the heat exchanger is in the form of a tubular combustion chamber and a gas burner is mounted on the outside of the casing and arranged to fire the hot combustion gases into the chamber.

5. A water heater as claimed in claim 4, wherein the burner is a high intensity packaged burner.

6. A water heater as claimed in claim 4, wherein the heat exchanger extends across the casing, and wherein a deflector member is positioned within said casing above the first gas outlet means connected to said heat exchanger.

7. A water heater as claimed in claim 4, wherein the heat exchanger houses a gas burner and forms a combustion chamber, the gas burner being arranged to fire the hot combustion gases into the chamber.

8. A water heater as claimed in claim 7, wherein the first gas outlet means connected to said heat exchanger comprises a plurality of tubes extending upwardly from the heat exchanger through the reservoir, and wherein a deflector member is positioned within said casing above each tube.

9. A water heater as claimed in claim 1, wherein the water distribution means is a plate extending across the casing below the feed water inlet means, the distribution means having a predetermined number and size apertures formed therein.

10. A water heater as claimed in claim 1, wherein the water distribution means comprises a tube extending across the casing below the feed water inlet means, the tube having a predetermined number and size of apertures formed therein.

11. A water heater as claimed in claim 1, wherein the second gas outlet means includes a demister means therein.

* * * * *